US008960891B2

(12) United States Patent
Häcker et al.

(10) Patent No.: US 8,960,891 B2
(45) Date of Patent: Feb. 24, 2015

(54) PRINTING MACHINE

(75) Inventors: Christoph Alban Häcker, Karlstadt (DE); Frank Eberhard Huppmann, Zell am Main (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 14/119,275

(22) PCT Filed: May 25, 2012

(86) PCT No.: PCT/EP2012/059835
§ 371 (c)(1),
(2), (4) Date: Nov. 21, 2013

(87) PCT Pub. No.: WO2012/163829
PCT Pub. Date: Dec. 6, 2012

(65) Prior Publication Data

US 2014/0184710 A1 Jul. 3, 2014

(30) Foreign Application Priority Data

Jun. 1, 2011 (DE) ..... 10 2011 076899
Dec. 16, 2011 (DE) ..... 10 2011 088776

(51) Int. Cl.
*B41J 2/01* (2006.01)
*B41J 11/00* (2006.01)
*B41J 3/60* (2006.01)
*B41J 15/16* (2006.01)

(52) U.S. Cl.
CPC ..... *B41J 11/0015* (2013.01); *B41J 3/60* (2013.01); *B41J 11/002* (2013.01); *B41J 15/165* (2013.01); *B41J 15/16* (2013.01)
USPC ..... 347/102; 347/101

(58) Field of Classification Search
USPC ..... 347/102, 101, 16, 17, 38, 40, 104, 106
See application file for complete search history.

(56) References Cited

U.S. PATENT DOCUMENTS

| | | | | | |
|---|---|---|---|---|---|
| 4,584,939 | A | * | 4/1986 | Giori | 101/152 |
| 4,592,278 | A | * | 6/1986 | Tokuno et al. | 101/181 |
| 5,479,856 | A | * | 1/1996 | Wirz | 101/177 |
| 5,566,616 | A | | 10/1996 | Schleinz et al. | |
| 5,713,138 | A | | 2/1998 | Rudd | |

(Continued)

FOREIGN PATENT DOCUMENTS

| | | | |
|---|---|---|---|
| DE | 10 2008 047 027 | A1 | 3/2010 |
| EP | 0 870 613 | A1 | 10/1998 |

(Continued)

*Primary Examiner* — Laura Martin
*Assistant Examiner* — Leonard S Liang
(74) *Attorney, Agent, or Firm* — Mattingly & Malur, PC

(57) ABSTRACT

The invention relates to a printing machine, wherein the printing machine has at least one first printing unit and at least one first dryer, wherein the at least one first printing unit has at least one inkjet print head, at least one first central cylinder, and an integral first drive motor dedicated to the at least one first central cylinder, and wherein the at least one first dryer is embodied as a radiation dryer, and wherein the at least one first dryer has at least one ventilating device, which has at least one air infeed line and at least one air removal line, and wherein at least one first cooling unit is arranged downstream of the at least one first dryer along a transport path of a printing material through the printing machine.

20 Claims, 4 Drawing Sheets

(56) References Cited

U.S. PATENT DOCUMENTS

| | | | | |
|---|---|---|---|---|
| 5,907,997 | A * | 6/1999 | Jackson et al. | 101/180 |
| 5,966,836 | A | 10/1999 | Valdez, III et al. | |
| 6,053,107 | A | 4/2000 | Hertel et al. | |
| 6,070,977 | A * | 6/2000 | Nuita et al. | 347/104 |
| 7,362,345 | B2 * | 4/2008 | Kitamura et al. | 347/176 |
| 7,455,401 | B2 * | 11/2008 | Koto et al. | 347/104 |
| 8,182,079 | B2 * | 5/2012 | Makuta | 347/102 |
| 8,328,321 | B2 * | 12/2012 | Tsuzawa | 347/18 |
| 8,371,689 | B2 * | 2/2013 | Izawa et al. | 347/102 |
| 2002/0166470 | A1 | 11/2002 | Nedblake, Jr. et al. | |
| 2010/0188468 | A1 | 7/2010 | Herpel et al. | |
| 2011/0063389 | A1 | 3/2011 | Hanson et al. | |
| 2011/0195200 | A1 * | 8/2011 | Behrens et al. | 427/534 |
| 2011/0273523 | A1 * | 11/2011 | Tsukamoto et al. | 347/103 |
| 2012/0154498 | A1 * | 6/2012 | Chiwata | 347/102 |
| 2012/0249648 | A1 * | 10/2012 | Katayama | 347/16 |
| 2012/0274718 | A1 * | 11/2012 | Houjou | 347/102 |

FOREIGN PATENT DOCUMENTS

| | | | |
|---|---|---|---|
| EP | 1 847 388 | A2 | 10/2007 |
| EP | 2 202 081 | A1 | 6/2010 |
| JP | 2003-063707 | A | 3/2003 |

* cited by examiner

PRINTING MACHINE

CROSS REFERENCE TO RELATED APPLICATIONS

This application is the U.S. National Phase, under 35 USC 371, of PCT/EP2012/059835, filed May 25, 2012; published as WO 2012/163829A1 on Dec. 6, 2012 and claiming priority to DE 10 2011 076 899.8, filed Jun. 1, 2011 and to DE 10 2011 088 776.8, filed Dec. 16, 2011, the disclosures of which are expressly incorporated herein by reference.

FIELD OF THE INVENTION

The present invention relates to a printing machine which has at least one first printing unit and at least one first dryer. The at least one first printing unit has at least one inkjet printing head, at least one first central cylinder and an integratal drive motor which is dedicated to the at least one first central cylinder. The at least one dryer is embodied as a radiation dryer. At least one cooling unit is arranged downstream of the at least one first dryer along a transport path of a printed material through the printing machine.

BACKGROUND OF THE INVENTION

Various printing methods that can be used in rotary printing machines are known. One such printing method is inkjet printing or ink-jet printing. In this method, individual droplets of printing ink are ejected from nozzles in print heads and transferred to a printing material so as to produce a printed image on the printing material. By controlling a plurality of nozzles individually, different printed images can be produced. No set printing forme is used, thus each individual printed product can be designed separately. This allows personalized printed products to be produced and/or, since no printing formes are used, allows small print runs of printed products to be produced at low cost.

The precise alignment of a printed image on the front and back sides of a printing material imprinted on both sides is referred to as register (DIN 16500-2). In multicolor printing, when individual printed images of different colors are combined in precise alignment to form a single image, this is referred to as color registration (DIN 16500-2). In inkjet printing, suitable measures must also be implemented to maintain color registration and/or register.

EP 2 202 081 A1 and JP 2003-063707 A each disclose a printing machine in which the printing machine comprises a first printing unit and a dryer, wherein the first printing has a central cylinder with an integral drive motor dedicated to the first central cylinder, and at least one inkjet print head.

From U.S. Pat. No. 5,566,616 A a printing machine is known which has a rotatable central cylinder, inkjet print heads, a cooling unit and a dryer, which operates either using temperature and air flow or using radiation-induced curing.

From U.S. Pat. No. 6,053,107 A a printing machine is known which has a driven central cylinder and a dryer with a cooling unit.

From U.S. Pat. No. 5,713,138 A a dryer is known which uses radiation to heat a central cylinder from the inside, with a printing material being in contact with the outside of said cylinder, said dryer also having a system for conducting air through an intervening space.

US 2002/166470 A1 and U.S. Pat. No. 5,566,616 each disclose a printing machine which has at least one first printing unit and at least one first dryer, wherein the at least one first printing unit has at least one inkjet print head, at least one first central cylinder and an integral first drive motor, dedicated to the at least one first central cylinder, and wherein the at least one first dryer is embodied as a radiation dryer, and wherein at least one first cooling unit is arranged downstream of the at least one first dryer along a transport path of a printing material through the printing machine.

EP 0 870 613 A1, DE 10 2008 047 027 A1 and EP 1 847 388 A2 each disclose a dryer of a printing machine which is embodied as a radiation dryer and which has at least one ventilating device, which has at least one air infeed line and at least one air removal line.

From US 2011/063389 A1 a printing machine is known, which has at least one first printing unit and at least one first dryer, wherein the at least one first printing unit has at least one inkjet print head and wherein the at least one first dryer has at least one ventilating device, which has at least one air infeed line and at least one air removal line, and wherein the transport path of the printing material through an area of action of the at least one first dryer extends at least 75% in at least one direction having a greater vertical component than an optionally existing horizontal component.

SUMMARY OF THE INVENTION

The object of the invention is to devise a printing machine.

The object is attained according to the invention by the provision of at least one dryer with at least one ventilating device which is at least one air infeed line and at least one air removal line. The transport path of the printed material through an area of action of at least one dryer extends at least 75% in at least one direction having a greater vertical component than an optionally existing horizontal component. A straight line which connects a rotational axis of the at least one first central cylinder of the at least one first printing unit with a rotational axis of at least one second central cylinder of at least one second printing unit intersects at least one dryer unit which comprises the at least one first dryer.

The advantages to be achieved by the invention consist particularly in that high-quality printed products can be produced using a compact construction. More particularly, the arrangement of corresponding dryer and cooling units allows a printing material, particularly a printing material web, to be dried over short transport paths. Short transport paths allow difficulties with color registration and/or register to be avoided, and allow the quantity of paper wastage to be minimized. Corresponding arrangements of printing units and dryers allow any smearing of printed images to be avoided. The preferred configuration of a dryer unit having two dryers improves the accessibility of printing units and dryers and ensures an optimized transport path for the printing material and particularly the printing material web. A preferred use of at least one radiation dryer improves energy efficiency, particularly in the case of an infrared radiation dryer. This is preferably enhanced by a combination of radiation dryer and airflow dryer. For this purpose, at least one ventilating device is preferably provided on the at least one dryer.

A further advantage is that a web tension of the printing material web can be particularly effectively adjusted. This advantage results, for example, from a preferred plurality of driven rotating bodies and corresponding impression rollers which are in contact with said bodies. In addition to avoiding web breaks and/or sagging, this preferred adjustment of web tension also ensures an improvement of color registration and/or register, since stretching of the printing material web is directly dependent on forces acting on the printing material web. At least one central cylinder and/or at least one cooling impression roller are preferably used as rotating bodies of this type, for example.

A further advantage is that a particularly precise positioning of the printing material and particularly of the printing material web relative to one or preferably multiple central cylinders is possible, and as a result, a printed image can be imprinted particularly precisely, that is, color registration and/or register can be improved.

BRIEF DESCRIPTION OF THE DRAWINGS

One embodiment example of the invention is illustrated in the set of drawings and will be specified in greater detail in the following.

The drawings show.

DESCRIPTION OF THE PREFERRED EMBODIMENT

Figure 1:
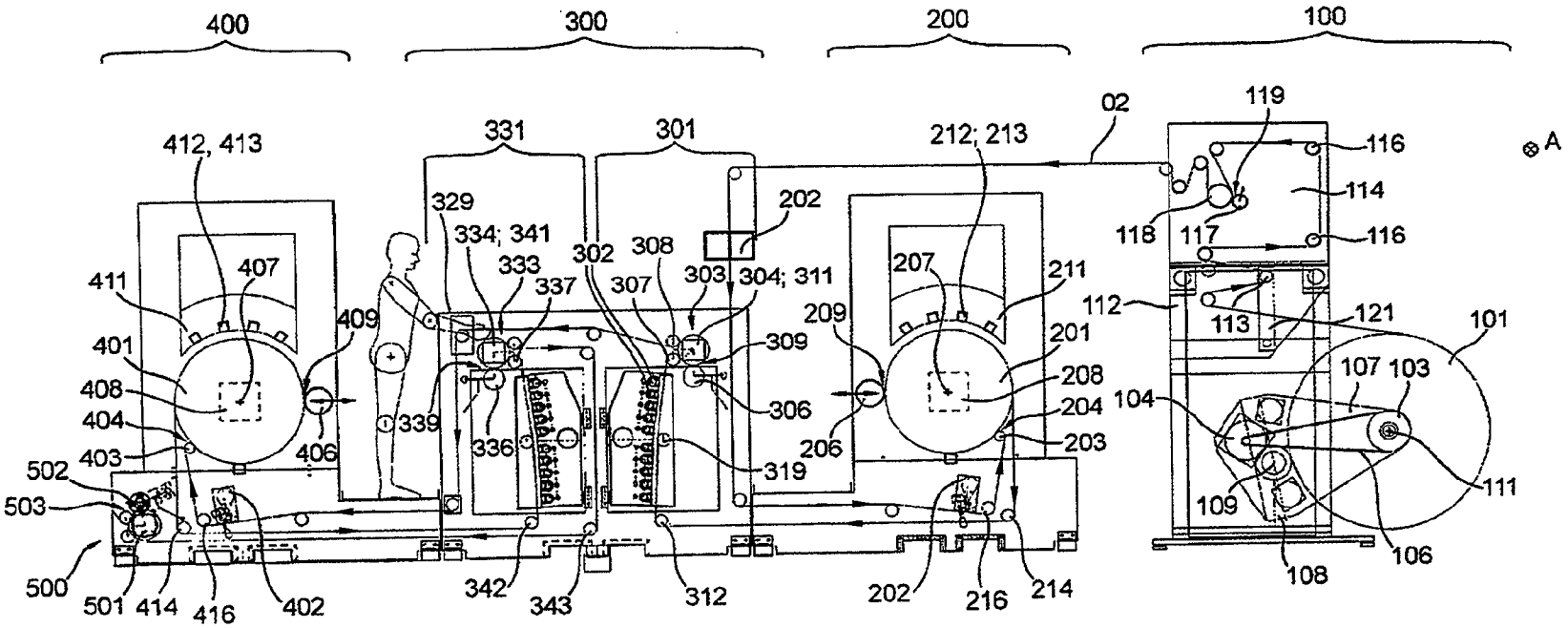
FIG. 1 a schematic illustration of a web-fed rotary printing machine.
Figure 2:
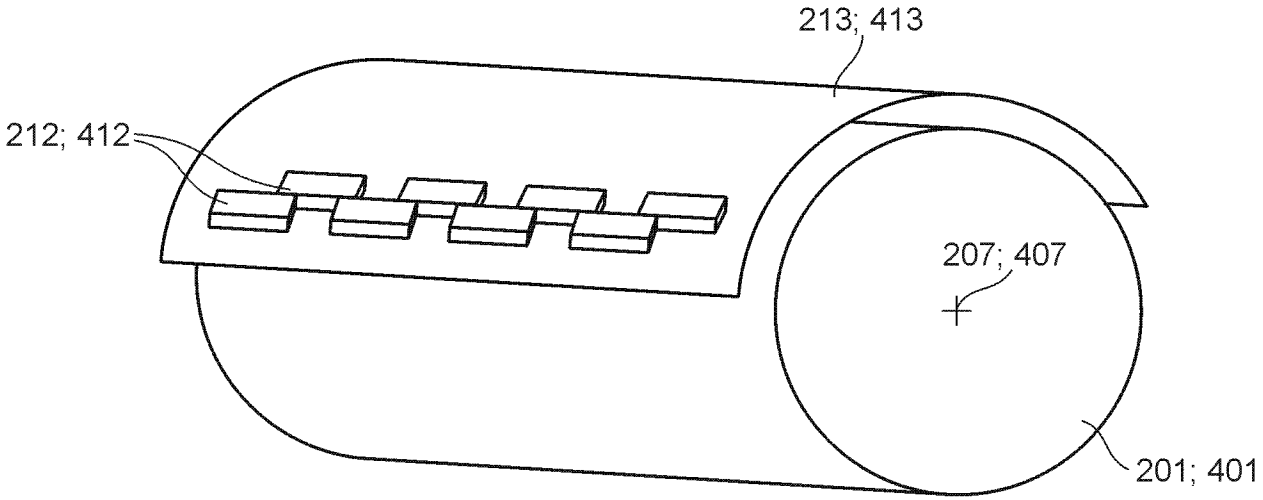
FIG. 2 a schematic illustration of part of a printing unit having a double row of print heads.

A printing machine 01, embodied as one of a rotary printing machine or as a web-fed printing machine, has at least one printing material source 100, at least one first printing unit 200, at least one first dryer 301, preferably at least one second printing unit 400, and at least one post-processing apparatus 500. Moreover, the printing machine 01 is preferably embodied as an inkjet printing machine and, particularly as a web-fed inkjet printing machine. The printing machine 01 is preferably embodied as a web-fed printing machine or a web-fed rotary printing machine. In this case, the printing material source 100 may be embodied as a roll unwinding device. In the case of a sheet-fed printing machine or a sheet-fed rotary printing machine, the printing material source 100 is embodied as a sheet feeder. In the printing material source 100, printing material 02 is aligned, preferably with respect to at least one edge of the printing material 02. In the roll unwinding device of a web-fed printing machine, a web-type printing material, that is, a printing material web, for example, a paper web or a textile web or a film, for example, a plastic film or a metal film, is unwound from a printing material roll 101 and is preferably aligned with respect to its edges. The printing material 02 and particularly the printing material web is then guided through the at least one first printing unit 200, wherein the printing material 02 and particularly the printing material web is provided on at least one side and preferably on both sides with a printed image using at least one printing ink.

After passing through the at least one first printing unit 200, the printing material 02 and particularly the printing material web passes through the at least one first dryer 301 in order to dry the printing ink that has been applied. Printing ink in the above and in what follows is generally understood as a coating agent, particularly a varnish. The at least one first dryer 301 is preferably a component of a dryer unit 300. After passing through the at least one first dryer 301 and preferably the at least one second printing unit 400 and/or at least one second dryer 331, the printing material 02 and particularly the printing material web is preferably fed to the at least one post-processing apparatus 500, where it is further processed. The at least one post-processing apparatus 500 is embodied, for example, as at least one folding device and/or as a winding device. In the at least one folding device, the printing material 02, which has preferably been imprinted on two sides, is further processed to produce individual printed products. More particularly, this means that at least the first dryer 301, preferably followed by at least the second printing unit 400, which is preferably followed by the at least one second dryer 331, is arranged downstream of the at least one first printing unit 200 along a transport path of the printing material 02 and particularly of the printing material web through the printing machine 01. This serves to ensure a high-quality, two-sided printing of the printing material 02 and particularly of the printing material web.

In what follows, a web-fed embodiment of the printing machine 01 will be described in greater detail. However, relevant details may also be transferred to other printing machines 01, for example, sheet-fed printing machines, as long as no incompatibilities exist. Printing material rolls 101, which are preferably used in the roll unwinding device, which may form the printing material source 100, preferably each have a core onto which the web-type printing material is wound for use in the web-fed embodiment of the printing machine 01. The printing material web preferably has a width of 700 mm to 900 mm, but may also have any smaller or preferably larger width. At least one printing material roll 101 is rotatably arranged in the roll unwinding device. In one variant, the roll unwinding device is suitably embodied for receiving one printing material roll 101, and thus has only one storage position for a printing material roll 101. In another variant, the roll unwinding device is embodied as a roll changer and has storage positions for at least two printing material rolls 101 and preferably enables a flying roll change, that is, a connection of a first printing material web of a printing material roll 101 currently being processed to a second printing material web of a printing material roll 101 that will subsequently be processed, while both the printing material roll 101 currently being processed and the printing material roll 101 that will subsequently be processed are rotating.

The roll unwinding device has at least one chucking device 103, preferably embodied as two chucking mandrels or chucking cones or one clamping shaft, per storage position. The at least one chucking device 103 is used for rotatably mounting at least one printing material roll 101. The at least one chucking device 103 is preferably driveable and/or driven by at least one drive motor 104, or by one drive motor per chucking device. This at least one drive motor 104 of the at least one chucking device 103 is preferably connected via at least one belt 106, for example, a toothed belt, with the respective chucking mandrel or mandrels. The at least one chucking device 103 and/or the drive motors 104 thereof are preferably connected via one supporting arm 107 each to a preferably common axle or a common support or a common support frame 108, around which all storage positions are rotatably arranged. This allows the at least one printing material roll 101 to be adjusted in terms of the position of its rotational axis 111 and its outer surface during a mounting of the at least one printing material roll 101 in the roll unwinding device and/or during a removal of a residual core or residual roll of the printing material roll 101 from the roll unwinding device and/or during a flying roll change and/or during an ongoing printing operation as the roll diameter decreases.

To allow a printing material roll 101 to be clamped onto the at least one chucking device 103, in the case of chucking mandrels, at least one of the chucking mandrels and preferably both of the chucking mandrels are displaceable in and/or counter to an axial direction A. This axial direction A is aligned parallel to the rotational axis 111 of the printing material roll 101 and optionally parallel to a pivot axis 109 of the common axle or the common support or the common support frame 108 of the roll unwinding device. This means that the axial direction A is also a direction A along the width of the printing material web 02. In the following, the case of chucking mandrels will be described; however, all the specifications may also be applied to the at least one chucking device 103 in general. When the printing material roll 101 is in a loaded state on the axle, the rotational axis 111 of the printing material roll 101 is at the same time the rotational axis 111 of the chucking mandrels that are in contact with said printing material roll 101. The chucking mandrels preferably each have at least two carrier elements embodied as clamping jaws. The chucking mandrels further each have a supporting journal, to which the clamping jaws are preferably movably connected. The position of the clamping jaws is adjustable at least in a radial direction with respect to a rotational axis of the chucking mandrels, which coincides with the rotational axis 111 of the printing material roll 101. When the clamping jaws are in a freely operating state, all the components of the clamping jaws lie within a radius defined by a maximum radial dimension of the supporting journal, and when the clamping jaws are in a clamped operating state, parts of the clamping jaws lie outside of this radius.

The roll unwinding device preferably further has a frame 112, which holds the common support frame 108, and preferably has a dancer roller 113 that can be deflected on a dancer lever 121, by means of which dancer roller 113, a web tension can be adjusted and can be and/or is held within certain limits, and inconsistencies in web tension, for example, in the case of printing material rolls 101 running out of round, are compensated for. The roll unwinding device optionally has a splicing and cutting unit, which can be used to implement a flying roll change, i.e., without stopping the movement of the printing material web.

The roll unwinding device further has a web edge aligner 114, also called a web aligner. This web edge aligner 114 has at least two alignment rollers 116, aligned at least substantially and preferably precisely parallel to one another, which, during printing operation, are wrapped by the printing material web, with the rotational axes of the alignment rollers 116 being adjustable individually and/or together with respect to their respective angular position in space and/or with respect to a direction of transport of the printing material 02. The two alignment rollers 116 are preferably arranged on a frame and are pivotable together about a pivot axis which is oriented perpendicular to a plane that contains the rotational axes of the alignment rollers 116. By means of the web edge aligner 114, the printing material web is aligned in terms of its lateral position, that is, the position of its web edges is aligned with respect to the axial direction A along its width, which lies orthogonally to the direction of transport of the printing material web. For this purpose, the at least two alignment rollers 116 are aligned on the basis of measurement signals from at least one sensor such that the position of the printing material web wrapping around the alignment rollers 116 can be adjusted very rapidly with respect to the direction orthogonally to the direction of transport of the printing material web. For longer-term, tendential alignments of the printing material web, the entire printing material roll 101 is preferably moved in the direction of its rotational axis 111. To better utilize space, for example, the web edge aligner 114 is preferably arranged above the supporting arms 107 of the roll unwinding device. At least one traction roller 118 is arranged downstream of the web edge aligner 114, with a traction impression roller 117 arranged so as to interact with the traction roller 118. The traction roller 118 and the traction impression roller 117 together form an infeed nip 119, in which the printing material web is preferably clamped, and through which the printing material web is preferably conveyed. The infeed nip 119 is used for adjusting a web tension. The traction impression roller 117 preferably has an outer surface which is made of a flexible material, for example, an elastomer. A first printing unit 200 is positioned downstream of the roll unwinding device 100, with respect to the transport path of the printing material web. The first printing unit 200 has at least one first central printing cylinder 201, or central cylinder 201. During printing operation, the printing material web wraps at least partially around the first central cylinder 201. In this case, a wrap angle preferably measures at least 180°, and further preferably at least 270°. The wrap angle in this case is the angle, measured in the circumferential direction, of an outer cylinder surface of the first central cylinder 201 along which the printing material 02 and particularly the printing material web is in contact with the first central cylinder 201. Accordingly, during printing operation, preferably at least 50% and more preferably at least 75% of the outer cylinder surface of the first central cylinder 201, viewed in the circumferential direction, is in contact with the printing material web. This means that part of the outer surface of the at least one first central cylinder 201, provided as the contact surface between the at least one first central cylinder 201 and the printing material 02, preferably embodied as a printing material web, has a wrap angle around the at least one first central cylinder 201 of preferably at least 180° and more preferably at least 270°.

A first printing material cleaning device 202 or web cleaning device is arranged upstream of the first central cylinder 201 of the first printing unit 200 along the transport path of the printing material web, acting on the printing material web and/or aligned toward the transport path of the printing material web. The first printing material cleaning device 202 is preferably embodied as a first dust removal device. The first printing material cleaning device 202 preferably has at least one brush and/or at least one vacuum device and/or a device for electrostatically charging particles that adhere to the printing material web. The first printing material cleaning device 202 is dedicated at least to a first side and preferably to both sides of the printing material web, and is particularly aligned so as to act and/or be capable of acting at least on this first side of the printing material web and preferably on both sides of the printing material web. The infeed nip 119 formed by the traction roller 118 and the traction impression roller 117 is preferably located between the web edge aligner 114 having at least two alignment rollers 116 and the at least one first central cylinder 201 along the transport path of the printing material web. In a preferred variant, the at least one first printing material cleaning device 202 is located downstream of the infeed nip 119 and upstream of the first central cylinder 201 along the transport path of the printing material 02, acting on the printing material web and/or aligned toward the transport path of the printing material web.

A roller 203 of the first printing unit 200, embodied as a first deflecting roller, is arranged parallel to the first central cylinder 201. This first deflecting roller is arranged spaced from the first central cylinder 201. More particularly, a first gap 204 exists between the first deflecting roller and the first central cylinder 201, which first gap 204 is larger than one thickness of the printing material web. The thickness of the printing material web in this context is understood as the smallest dimension of the printing material web. The printing material web preferably wraps around part of the first deflecting roller and is deflected by said roller such that the transport path of the printing material web within the first gap 204 extends both tangentially to the first deflecting roller and tangentially to the first central cylinder 201. The outer surface of the deflecting roller in this case is preferably made of a relatively inflexible material, more preferably a metal, and more preferably still, steel or aluminum.

At least one cylinder 206, embodied as a first impression roller, is preferably arranged in the first printing unit 200. The first impression roller preferably has an outer surface made of a flexible material, for example, an elastomer. The first impression roller is preferably arranged so as to be engageable against the first central cylinder 201 and/or disengageable therefrom, more preferably in a linear direction of motion, and more preferably still, radially relative to a rotational axis 207 of the first central cylinder 201, by means of an adjustment drive. In a state in which the first impression roller is engaged against the first central cylinder 201, the impression roller, together with the first central cylinder 201, forms a first impression roller nip 209. During printing operation, the printing material web passes through the first impression roller nip 209. The printing material web is placed flat and preferably in a clear and known position against the first central cylinder 201 by the first deflecting roller 203 and/or preferably by the first impression roller. Apart from the first impression roller, preferably no additional rotating bodies, particularly no additional rollers and no additional cylinders, are in contact with the at least one central cylinder 201.

The first central cylinder 201 has an integral first drive motor 208 dedicated to the first central cylinder 201, said motor being preferably embodied as an electric motor and more preferably embodied as a direct drive and/or independent drive of the first central cylinder 201. A direct drive is understood in this context as a drive motor 208 which is connected to the at least one first central cylinder 201 so as to transfer and/or be capable of transferring torque, without interconnection of additional rotating bodies that are in contact with the printing material 02. An independent drive is understood in this context as a drive motor 208, embodied as a drive motor 208 exclusively for the at least one first central cylinder 201. The first drive motor 208 of the first central cylinder 201 is preferably embodied as a synchronous motor. However, an asynchronous motor may also be used. The first drive motor 208 of the first central cylinder 201 preferably has at least one permanent magnet, which more preferably is part of a rotor of the first drive motor 208 of the first central cylinder 201. On the first drive motor 208 of the first central cylinder 201 and/or on the first central cylinder 201 itself, a first rotational angle sensor is preferably arranged, which is embodied as measuring and/or capable of measuring a rotational angle position of the first drive motor 208 and/or of the first central cylinder 201 itself, and as transmitting and/or capable of transmitting said position to a higher-level machine controller. The first rotational angle sensor is embodied, for example, as a rotary encoder or as an absolute value encoder. With a rotational angle sensor of this type, a rotational position of the first drive motor 208 and/or preferably a rotational position of the first central cylinder 201 can preferably be determined in absolute terms by means of a higher-level machine controller. The first drive motor 208 of the first central cylinder 201 is preferably located at a first axial end of the first central cylinder 201, referred to the rotational axis 207 of the first central cylinder 201, whereas the rotational angle sensor is preferably located at a second axial end of the first central cylinder 201, referred to the rotational axis 207 of the first central cylinder 201. The rotational angle sensor preferably has a particularly high resolution, for example, a resolution of at least 3,000 (three thousand) and preferably at least 10,000 (ten thousand) increments per round angle (360°). The rotational angle sensor preferably has a high sampling frequency.

At least one first printing element 211 is arranged within the first printing unit 200. The at least one first printing element 211 is preferably arranged downstream of the first impression roller 206 in the direction of rotation of the first central cylinder 201 and therefore along the transport path of the printing material web, acting and/or capable of acting on and/or aligned toward the central cylinder 201. The at least one first printing element 211 is embodied as a first inkjet printing element, and is also called the first ink-jet printing element. The first printing element 211 has at least one nozzle bar 213 and preferably a plurality of nozzle bars 213. The at least one first printing element 211 and therefore the at least one first printing unit 200 has at least one first print head 212, embodied as an inkjet print head. The at least one nozzle bar 213 preferably has at least one and preferably a plurality of print heads 212. Each print head 212 preferably has a plurality of nozzles, from which droplets of printing ink are ejected and/or can be ejected. A nozzle bar 213 in this context is a component which preferably extends across at least 80% and more preferably at least 100% of the width of the printing material web and/or the axial length of the body of the first central cylinder 201, and serves as a support for the at least one print head 212. In this case, a single nozzle bar 213 or a plurality of nozzle bars is provided per printing element 211. A clearly defined target region, referred to the direction A along the width of the printing material web and therefore to the direction A of the rotational axis 207 of the first central cylinder 201, is assigned to each nozzle. Each target region of a nozzle is clearly defined, particularly in reference to the circumferential direction of the first central cylinder 201.

The at least one first nozzle bar 213 extends in the axial direction A, that is, in the direction A along the width of the printing material web, across the entire width of the printing material web. The at least one nozzle bar 213 has at least one row of nozzles. The at least one row of nozzles, viewed in the axial direction A, preferably has nozzle openings at regular distances over the entire width of the printing material web and/or of the body of the first central cylinder 201. In one variant, a single, continuous print head is provided for this purpose, extending in the axial direction A over the entire width of the printing material web and/or the entire width of the body of the first central cylinder 201. In this case, the at least one row of nozzles is embodied as at least one linear row of individual nozzles, extending across the entire width of the printing material web in the axial direction A. In another variant, multiple print heads are arranged side by side on the at least one nozzle bar 213 in the axial direction A. Since such individual print heads usually are not equipped with nozzles up to the edge of the housing of said heads, preferably at least two and more preferably precisely two rows of print heads extending in the axial direction A are arranged offset from one another in the circumferential direction of the first central cylinder 201, preferably such that successive print heads are always alternatingly assigned to one of the at least two rows of print heads in the axial direction A, preferably always alternatingly to a first and a second of two rows of print heads. Two such rows of print heads form a double row of print heads 212. Each double row of print heads preferably has between five and fifteen print heads, and more preferably seven print heads. The at least one row of nozzles then is not embodied as a single linear row of nozzles, and is instead produced from the total of individual, particularly of two, rows of nozzles arranged offset from one another in the circumferential direction.

If a print head 212 has multiple nozzles, then all the target regions of the nozzles of this print head 212 together form an operating region of said print head 212. Operating regions of print heads 212 of a nozzle bar 213, and particularly of a double row of print heads, adjoin one another in the axial direction A and/or overlap one another in the axial direction A. This serves to ensure that, even if the print head 212 is not continuous in the axial direction A, target regions of nozzles of the at least one nozzle bar 213 and/or particularly of each double row of print heads lie at regular and preferably periodic distances from one another, viewed in the axial direction A. In any case, an entire operating region of the at least one nozzle bar 213 preferably extends across at least 90% and more preferably across 100% of the total width of the printing material web and/or the total width of the body of the first central cylinder 201 in the axial direction A. A narrow region of the printing material web and/or of the body of the first central cylinder 201 which is not part of the operating region of the nozzle bar 213 can be present on one or both sides with respect to the axial direction A. A total operating region of a double row of print heads corresponds to the operating region of the at least one nozzle bar 213, viewed in the direction A along the width of the printing material web 02.

The at least one nozzle bar 213 preferably has multiple rows of nozzles in the circumferential direction with respect to the at least one first central cylinder 201. Each print head 212 preferably has a plurality of nozzles, which are arranged in a matrix of multiple lines in the axial direction A and/or multiple columns in the circumferential direction of the at least one first central cylinder 201. A plurality of rows of print heads, more preferably four double rows and more preferably still eight double rows of print heads, are preferably arranged one after another in a direction orthogonally to the axial direction A. Further preferably, a plurality of rows of print heads, more preferably four double rows, and more preferably still eight double rows of print heads 212 are arranged one after another in the circumferential direction with respect to the at least one first central cylinder 201, aligned toward the at least one first central cylinder 201. In this case, the print heads 212 are preferably aligned such that the nozzles of each print head 212 point substantially in a radial direction toward the outer cylinder surface of the at least one first central cylinder 201. This means that the at least one print head 212 aligned toward the outer surface of the at least one first central cylinder 201 is aligned with respect to the rotational axis 207 of the at least one first central cylinder 201 in a radial direction toward the outer surface of the at least one first central cylinder 201. This radial direction is a radial direction referred to the rotational axis 207 of the at least one first central cylinder 201. Each double row of print heads is preferably assigned a printing ink of a specific color, for example one of the colors black, cyan, yellow and magenta, or a varnish, for example, a clear varnish. The corresponding inkjet printing element is preferably embodied as a four-color printing element and enables one-sided, four-color printing of the printing material web. It is also possible to print using fewer or more different colors, for example, additional special inks, using one printing element 211. More or fewer print heads and/or double rows of print heads are then preferably arranged accordingly within this corresponding printing element 211. In one variant, a plurality of rows of print heads, more preferably four double rows, and more preferably still eight double rows of print heads, are arranged aligned one after another on at least one surface of at least one transfer element, for example, at least one transfer cylinder and/or at least one transfer belt.

The at least one print head 212 operates by generating droplets of printing ink, preferably according to the drop-on-demand method. In principle, it is also conceivable to use print heads which operate according to another method for generating droplets of printing ink, for example, the continuous inkjet method. In the drop-on-demand method, droplets of printing ink are produced in a targeted manner as needed. At least one piezoelectric element, which is capable of decreasing a volume filled with printing ink by a specific percentage at high speed when a voltage is applied to it, is preferably used per nozzle. In this manner, printing ink is displaced and is ejected through a nozzle that is connected to the volume filled with printing ink, forming at least one droplet of printing ink. The adjustment path of the piezoelectric element and therefore the decrease in volume and therefore the size of the printing ink droplets can be influenced by applying different voltages to the piezoelectric element. This allows color gradations to be produced in the resulting printed image without adjusting the number of droplets that contribute to forming the printed image (amplitude modulation). It is also possible to use at least one heating element per nozzle, which produces a gas bubble at high speed in a volume filled with printing ink by vaporizing printing ink. The additional volume of the gas bubble displaces printing ink, which is in turn ejected through the corresponding nozzle and forms at least one droplet of printing ink.

In the drop-on-demand method, a deflection of droplets following the ejection thereof from the corresponding nozzle is not necessary, since a target position for the respective printing ink droplet on the moved printing material web can be defined with respect to the circumferential direction of the first central cylinder 201, solely on the basis of the emission time of said printing ink droplet and the rotational speed of the first central cylinder 201. By controlling each nozzle separately, droplets of printing ink are transferred by the at least one print head 212 onto the printing material web only at selected times and at selected locations. This is carried out on the basis of the rotational speed of the central cylinder 201, the distance between the respective nozzle and the printing material web and the position of the target region of the respective nozzle with respect to the circumferential angle. This results in a desired printed image, which is configured based on the actuation of all nozzles.

The alignment of the printing material web by means of the web edge aligner 114, and the first impression roller 206 of the first printing unit 200, and the large wrap angle of the printing material web around the first central cylinder 201 serve to ensure that the printing material web is arranged without slip in a precisely defined position on the outer surface of the first central cylinder 201 and remains in said position until the specific release thereof at the end of the region of the wrap angle. The contact of the printing material web with the outer surface of the first central cylinder 201 also prevents or at least reduces to a sufficient degree the swelling of the printing material web, at least in the direction of transport of the printing material web and at least for the duration of contact of a respective region of the printing material web with the outer surface of the first central cylinder 201, even following contact with printing ink droplets. It is thereby ensured that printing ink droplets from different print heads 211 are applied to a printing material web that is arranged in a uniformly defined manner. The precise and constant positioning of the printing material web relative to the first central cylinder 201 is of great importance to precise color registration and/or a true-to-register printed image.

The nozzles of the at least one print head 212 are arranged such that the distance between the nozzles and the printing material web arranged on the outer surface of the central cylinder 201 preferably measures between 0.5 mm and 5 mm, and more preferably between 1 mm and 1.5 mm. The high angular resolution and/or the high sampling frequency of the rotational angle sensor enable a highly precise determination of the position of the printing material web relative to the nozzles and the target regions thereof. A droplet flight time between the nozzles and the printing material web is known, for example, based on a learning process and/or based on the known distance between the nozzles and the printing material web and a known droplet velocity. From the rotational angle position of the first central cylinder 201, the rotational speed of the first central cylinder 201 and the droplet flight time, an ideal time for ejection of a respective droplet is determined, so that a precise color registration and/or true-to-register printing of the image on the printing material web is achieved.

At least one sensor, embodied as a first printing image sensor, is preferably provided, more preferably arranged at a position downstream of the first printing element 211 along the transport path of the printing material web. The at least one first printed image sensor can be embodied, for example, as a first line camera or as a first surface camera. By means of this at least one first printed image sensor and a corresponding evaluation unit, for example, the higher-level machine controller, the actuation of all the print heads and/or double rows of print heads of the first printing element 211, arranged and/or acting one in front of the other in the circumferential direction of the first central cylinder 201, is monitored and controlled. In a first variant of the at least one printed image sensor, only one first printed image sensor is provided, the sensor field of which encompasses the entire width of the transport path of the printing material web. In a second variant of the at least one printed image sensor, only one first printed image sensor is provided, which is embodied as movable in the direction A, orthogonally to the direction of the transport path of the printing material web. In a third variant of the at least one printed image sensor, a plurality of printed image sensors are provided, the respective sensor fields of which each encompass different regions of the transport path of the printing material web. These regions are preferably arranged offset from one another in the direction A, orthogonally to the direction of the transport path of the printing material web. The totality of the sensor fields of the plurality of printed image sensors preferably encompasses the total width of the transport path of the printing material web.

The positioning of image points which are formed by droplets of printing ink coming from a respectively first print head 212 is preferably compared with the positioning of image points which are formed by droplets of printing ink, each of which comes from a second print head that lies downstream of the respective first print head 212 in the circumferential direction of the first central cylinder 201. This is preferably carried out independently of whether these first and second print heads, disposed and/or acting one in front of the other in the circumferential direction of the first central cylinder 201, process the same or a different printing ink. The coordination of the positions of the printed images that come from different print heads is monitored. When the same printing ink is used, a true-to-register merging of partial images is monitored. When different printing inks are used, color registration or color register is monitored. A quality control of the printed image is preferably also carried out on the basis of the measured values from the at least one printed image sensor. Depending on the speed with which individual nozzles can be actuated and operated, the printing material web might need to be imprinted multiple times with the same printing ink until the desired result can be achieved. For this purpose, at least two double rows of print heads, arranged one in front of the other in the circumferential direction of the first central cylinder 201, are preferably dedicated to each printing ink. Therefore, with a transport speed of the printing material web of 2 m/s and a four-color printing process, a resolution of 600 dpi (600 dots per inch) is achieved. Lower resolutions and/or fewer colors enable correspondingly higher transport speeds. A larger number of print heads is a further option for influencing the print resolution and/or transport speed and/or color selection that can be achieved. More particularly, a sufficiently high data processing speed of the controller that controls the print heads must be ensured.

During regular printing operation, all print heads are fixedly arranged. A consistently precise color registration and/or true-to-register alignment of all nozzles is thereby ensured. Various situations are conceivable in which a movement of the print heads may be necessary. A first such situation is a flying roll change or generally a roll change involving a splicing process. In such processes, a printing material web is connected by means of an adhesive strip to another printing material web. This results in a splice, which must pass through the entire transport path of the printing material web. The thickness of this splice, that is, the minimum dimension thereof, is greater than the thickness of the printing material web. Essentially, the splice is as thick as two printing material webs plus the adhesive strip. This can result in difficulties when the splice passes through the gap between the nozzles of the print heads 212 and the outer surface of the first central cylinder 201. The at least one nozzle bar 213 is therefore movable in a radial direction relative to the rotational axis 207 of the first central cylinder 201. This allows the distance to be increased sufficiently; however, it must later be decreased again accordingly. A second such situation results, for example, during the maintenance of at least one of the print heads. The print heads are preferably mounted individually on the at least one nozzle bar 213 and can be individually detached from the at least one nozzle bar 213. This allows individual print heads 212 to be maintained and/or cleaned and/or replaced.

When multiple nozzle bars 213 are arranged so as to be movable relative to one another, then when at least one nozzle bar 213 is returned to a printing position, minimal incorrect positions of nozzle bars 213 relative to one another may occur. It may thus become necessary to implement an alignment, particularly of all print heads of one nozzle bar 213 to print heads of other nozzle bars. When a new print head and/or a print head to be repositioned is mounted on the at least one nozzle bar 213 on which at least one other print head 212 is already mounted, a precisely matching alignment of this new print head or print head to be repositioned with the at least one already mounted print head 212, both in the circumferential direction and in the axial direction A with respect to the first central cylinder 201, will not necessarily occur, and will occur coincidentally at best. Thus in this case as well, an alignment may be necessary, particularly of an individual print head 212 in relation to other print heads of the same nozzle bar 213 and/or other nozzle bars.

At least one sensor detects the position of the target region of at least one new and/or repositioned print head relative to the position of the target region of at least one print head 212 that is already mounted. This is preferably accomplished on the basis of a comparison of the positions of image points produced by the respective print heads on the printing material web. The above-described at least one printed image sensor is preferably used as the sensor for this purpose. However, it is also possible to use another sensor different from the above-described printed image sensor for this purpose, for example, a sensor that is specialized for this task. These relative positions are evaluated by an evaluation unit, for example, the higher-level machine controller. An installation position of the at least one new and/or repositioned print head in the circumferential direction with respect to the first central cylinder 201 can be compensated for by actuating the nozzles of this print head, preferably similarly to the above-described adjustment of print heads of different double rows of print heads. An installation position of the at least one new and/or repositioned print head in the axial direction with respect to the first central cylinder 201 is compensated for by means of at least one adjustment mechanism. Each of a plurality of print heads preferably has its own integral adjustment mechanism, and more preferably, all print heads each have their own integral adjustment mechanism. It is conceivable for a print head 212 to be used as a reference, according to which all other print heads are aligned. This print head 212 used as a reference then does not require an integral adjustment mechanism. Each such adjustment mechanism has at least one linear drive, which is preferably embodied as an electric motor and more preferably as a stepper motor. For example, the linear drive has a spindle drive and/or a toothed rack and a pinion gear. Each print head is preferably arranged so as to move parallel to the axial direction A by means of the linear drive thereof.

Once at least one print head 212 has been installed, a test printing is run, in which the new print head and/or print head to be repositioned and at least one print head that serves as a reference transfer droplets of printing ink onto the printing material web. The test printing is preferably detected automatically by means of a sensor, for example, the first camera. In the event of a deviation in the actual position of the at least one new and/or repositioned print head, detected by means of the test printing, the position of this print head is preferably adjusted automatically in the axial direction A by means of the adjustment mechanism, and/or the actuation of the nozzles of this print head is adjusted with respect to a droplet ejection time.

The at least one nozzle bar 213 is preferably arranged so as to move in the axial direction A, preferably far enough that no nozzle of the nozzle bar 213 and/or no operating region of a print head of the nozzle bar 213 is in the same position with respect to the axial direction A as any component of the body of the first central cylinder 201. At least one linear guide is preferably provided for this purpose. A sliding carriage that supports the at least one nozzle bar 213 is arranged so as to move along the at least one linear guide. To perform maintenance on the printing element 211, the at least one nozzle bar 213 is preferably first disengaged from the first central cylinder 201 in a direction oriented radially to the rotational axis 207 of the first central cylinder 201, and is then moved in the axial direction A.

A protective cover is preferably provided, which can be moved into a position relative to the at least one nozzle bar 213 in which the protective cover is arranged covering all the nozzles of the at least one nozzle bar 213 that has been disengaged from the first central cylinder 201. The nozzles are thereby prevented from drying out. A nozzle cleaning device is preferably provided, which has a series of washing nozzles and/or brushes. This nozzle cleaning device is preferably movable from below up to the nozzles of the at least one nozzle bar 213. The nozzle cleaning device is preferably connected to the protective cover. The protective cover then serves simultaneously as a collecting tank for cleaning fluid and soil that exits the washing nozzles and that drips from the nozzles. The at least one nozzle bar 213 is movable entirely independently of those components of the printing machine 01 that are arranged in contact with the printing material web. Therefore, a cleaning and/or maintenance process of this type can be carried out without impacting the printing material web, and particularly without requiring that the printing material web be removed from the printing machine 01.

Once the printing material web has passed through the at least one first printing unit 200, the printing material web is transported further along its transport path, and is preferably fed to the at least one first dryer 301 of the at least one dryer unit 300. The at least one first dryer 301 is accordingly arranged downstream of the first printing element 211 and particularly downstream of the at least one first printing unit 200 with respect to the transport path of the printing material web. The first side of the printing material web, which is imprinted by the at least one first printing unit 200, is preferably not in contact with any component of the web-fed rotary printing machine 01 between a last point of contact of the printing material web with the at least one first central cylinder 201 of the at least one first printing unit 200 and an area of action of the at least one first dryer 301. The second side of the printing material web, which particularly is not imprinted by the first printing unit 200 and is in contact with the at least one first central cylinder 201 of the at least one first printing unit 200, is preferably in contact with at least one deflecting roller 214 of the at least one first printing unit 200 and/or with at least one deflecting roller 312 of the at least one first dryer 301 between the last point of contact of the printing material web with the first central cylinder 201 of the at least one first printing unit 200 and the area of action of the at least one first dryer 301. At least one deflecting roller 214, embodied as a measuring roller, of the first printing unit 200 is preferably provided, and deflects the printing material web, once the web has been released from the first central cylinder 201, in a direction having a greater, preferably downward-oriented vertical component than an optionally existing horizontal component, into a direction having a greater horizontal component than an optionally existing vertical component. In this case, only the second side of the printing material web, which has not been imprinted by the first printing unit 200, is in contact with this at least one deflecting roller 214 of the first printing unit 200. At least one deflecting roller 312 of the at least one first dryer 301 is preferably provided, which deflects the printing material web from this direction or another direction having a greater horizontal component than an optionally existing vertical component into a direction having a greater, preferably upwardly oriented vertical component than an optionally existing horizontal component. In this case, only the second side of the printing material web, which preferably has not been imprinted by the first printing unit 200 and is in contact with the at least one first central cylinder 201 of the at least one first printing unit 200, is in contact with the at least one deflecting roller 312 of the at least one first dryer 301.

Figure 5:
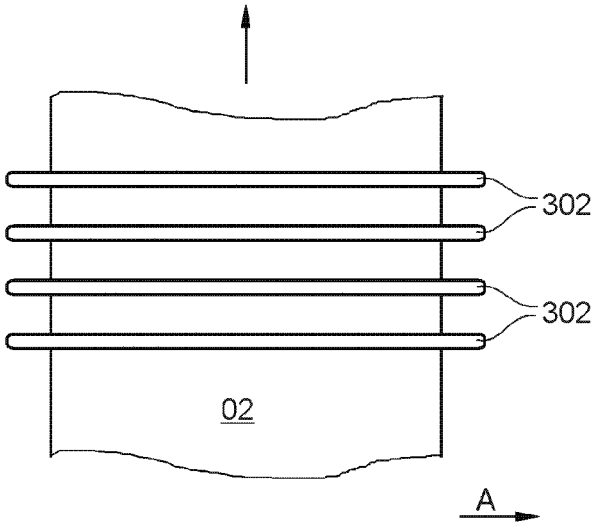
FIG. 5 a schematic illustration of a printing material web with multiple radiation sources of a dryer.

The at least one first dryer 301 is preferably embodied as an infrared radiation dryer. The at least one first dryer 301 has at least one and preferably multiple, more preferably at least six and more preferably still at least ten radiation sources, preferably embodied as infrared radiation sources 302, arranged one in front of the other in the transport direction of the printing material web as seen in FIG. 5. In this case, a radiation source 302, preferably an infrared radiation source, is a device by means of which electrical energy is converted or can be converted in a targeted manner to radiation, preferably infrared radiation, which is directed or can be directed toward the printing material web. The at least one radiation source 302 preferably has a defined area of action. More particularly, the area of action of each radiation source 302 is the area that contains all the points that can be connected, directly or via reflectors, in a straight line, particularly without interruption, to the radiation source 302. The area of action of the at least one first dryer 301 is comprised of the areas of action of all radiation sources 302 of the at least one first dryer 301. The area of action of the at least one first dryer 301 points from the at least one radiation source 302 to a part of the transport path of the printing material web 02 that is closest to the at least one radiation source 302.

The at least one radiation source 302 has a length and a width and a height. The length of the radiation source 302 is at least five times the size of the width and the height of the radiation source 302. The length of the at least one radiation source 302 preferably extends in the axial direction A, parallel to the rotational axis 207 of the at least one first central cylinder 201, and therefore in the direction A of the width of the printing material web. This means that the at least one first dryer 301 has at least one radiation source 302, which extends in a horizontal direction A, oriented orthogonally to the transport path of the printing material web through the at least one first dryer 301. The arrangement of multiple radiation sources 302 oriented in this manner, one in front of the other in the direction of transport of the printing material web, as seen in FIG. 5, allows the radiation output delivered as a whole onto the printing material web to be adjusted to an ink volume and/or ink density applied to the printing material web.

The at least one radiation source 302 preferably has at least one and further preferably two pipes, the diameters of which are preferably between 10 mm and 50 mm. The at least one tube is preferably made of a material that is at least partially permeable to radiation in the infrared range, more preferably a quartz glass. At least one incandescent element, preferably an incandescent coil or an incandescent strip, preferably made of wolfram and/or a wolfram alloy and/or carbon, is provided in the interior of each such tube. The incandescent element can be made of wolfram carbide, for example. A reflective coating is preferably applied to a side of the tube that faces away from the printing material web. The incandescent elements act as heating resistors, which produce heating and a heat output when acted on by a flow of current. Each radiation source 302 has a housing 316, as seen in FIG. 4, which preferably has at least one and more preferably a plurality of venting openings and which preferably is not situated between the incandescent elements and the printing material web. All the venting openings preferably lead to a common air removal line 318 which is shown in FIG. 3.

In one variant, which is preferably identical to the variant described above and in the following, with the exception of the alignment of the at least one radiation source 302, the length of the at least one radiation source 302 is aligned parallel to the direction of transport of the printing material web 02. A plurality of radiation sources 302 are then preferably arranged side by side in the direction A of the width of the printing material web 02. This means that the at least one first dryer 301 has at least one radiation source 302 which extends in a direction having at least one component oriented parallel to the transport path of the printing material 02 through the at least one first dryer 301. This allows printing material webs of different widths to be dried in an optimized fashion, without expending an unnecessary amount of energy and/or without risking overheating of the at least one first dryer 301. Dryer output can be adjusted via a preferably individual adjustment of the radiation output of the at least one radiation source 302.

However, the plurality of radiation sources 302 are preferably arranged parallel to one another with respect to their length. The plurality of radiation sources 302 are preferably arranged side by side in a direction which is aligned orthogonally to the length of the radiation sources 302 and/or which extends along the transport path of the printing material web. Therefore, a plurality of radiation sources 302 each preferably extend orthogonally to the direction of transport of the printing material web and are arranged one in front of the other, viewed in the direction of transport of the printing material web. As a result of the radiation that is output by the at least one radiation source 302, moisture is removed from the printing material web and/or from the printing ink located thereon, and is absorbed by the ambient air in the interior of the at least one first dryer 301. The transport path of the printing material web extends through this interior of the at least one first dryer 301. To achieve a consistently high drying performance, a temperature control of components of the at least one first dryer 301 and/or a ventilation of the interior of the at least one first dryer 301 are ensured. For this purpose, at least one temperature control device is preferably arranged in the region of the at least one radiation source 302. In a preferred variant, the temperature control device is embodied as a ventilating device. The ventilating device preferably also serves to remove moisture from the at least one first dryer 301.

Figure 3:
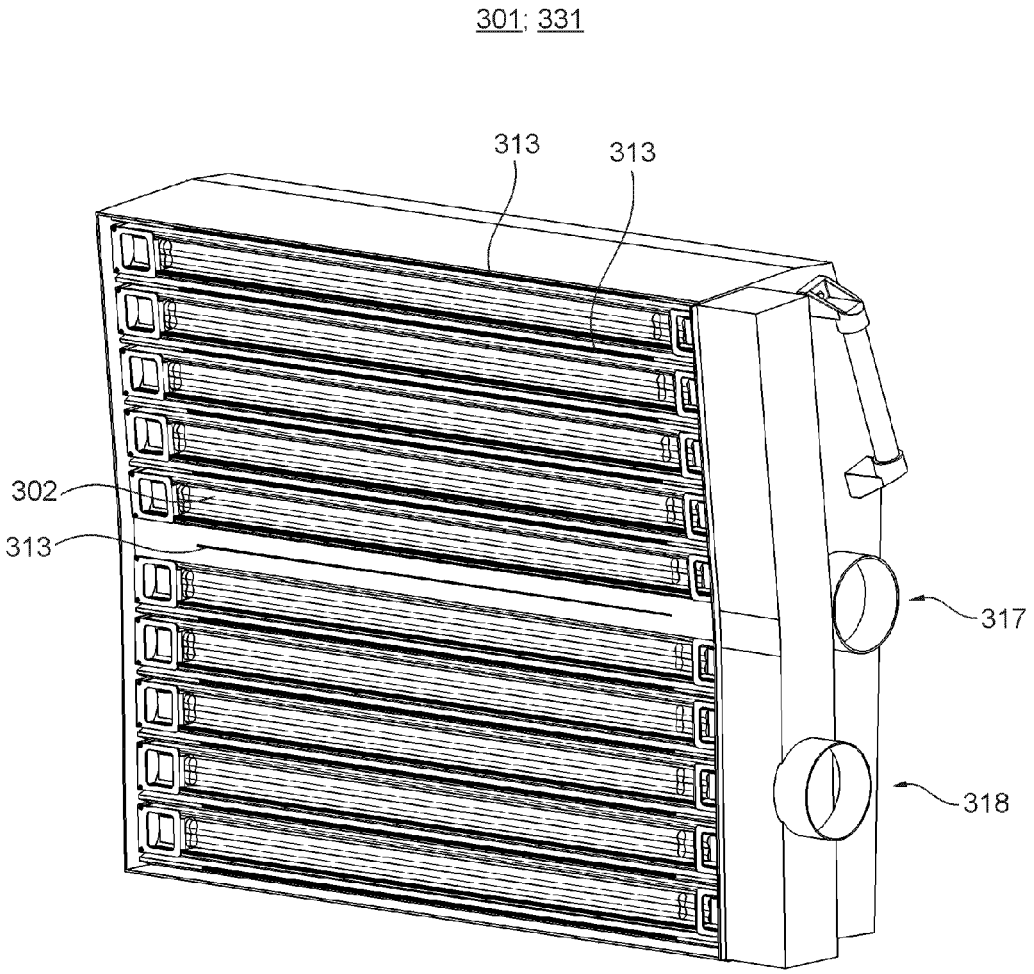
FIG. 3 a schematic illustration of part of a dryer.
Figure 4:
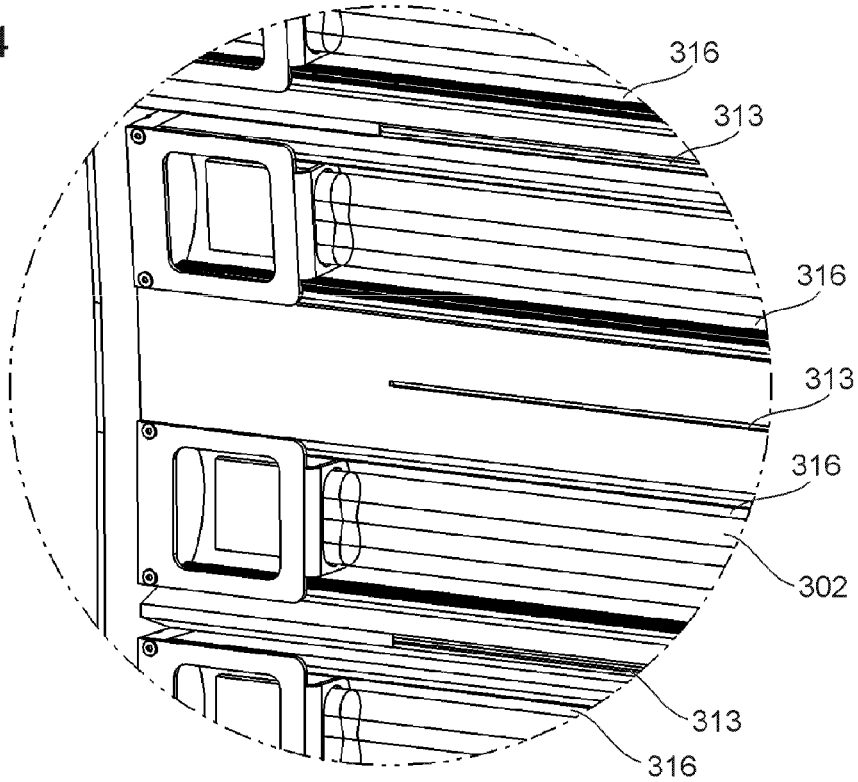
FIG. 4 a schematic, enlarged illustration of an area of FIG. 3.

The ventilating device has at least one air infeed line 317, as seen in FIG. 3, and preferably at least one ventilation opening 313 connected thereto, and an air removal line 318 and preferably at least one venting opening connected thereto. Air flows through the at least one ventilation opening 313 in a direction toward the interior of the at least one dryer 301. The at least one first dryer 301 is therefore likewise embodied as an air flow dryer, in addition to being embodied as a radiation dryer. Alternatively or additionally, the at least one first dryer 301 is embodied as a UV radiation dryer and/or as a pure air flow dryer, for example, a hot air dryer. At least one preferably slit-shaped ventilation opening 313 is preferably provided, as seen in FIG. 3. More preferably, at least one preferably slit-shaped ventilation opening 313 is arranged at least between two radiation sources 302 and more preferably still between every two radiation sources 302. The housing 316 of at least one and preferably of each radiation source 302 preferably has at least one venting opening, and more preferably, a plurality of venting openings, as seen in FIG. 4.

In one variant, such a temperature control device has at least one fluid temperature-controlled, preferably liquid temperature-controlled component, which is preferably arranged at a maximum distance of 50 cm, more preferably a maximum distance of 15 cm, from the at least one radiation source 302. Such a fluid temperature-controlled component is arranged in the area of action of the at least one first dryer 301, for example. Such a fluid temperature-controlled component is a printing material guide element, such as a printing material deflector plate, for example, which has at least one line through which temperature control fluid, and preferably temperature control liquid, flows and/or can flow, and/or is connected to such a line. Alternatively or additionally, in one variant, at least part of the housing 316 of at least one and preferably of each radiation source 302 has at least one line through which temperature control fluid and preferably temperature control liquid flows and/or can flow, and/or is connected to such a line. Water is used as the temperature control fluid, for example.

Air is conducted through the at least one ventilation opening 313 into the interior of the at least one first dryer 301. A positive pressure is preferably present in the first dryer 301. Inside the first dryer 301, water and/or solvent from the printing inks which is to be removed from the printing material web is removed by the infrared radiation and is absorbed by the introduced air. This air is then removed from the at least one first dryer 301 through the at least one venting opening. By removing this air which has absorbed the excess water and/or solvent, a saturation of the air located inside the first dryer 301 with water and/or solvent is avoided, while at the same time, thermal energy is removed from the interior of the dryer 301. This increases the efficacy of the first dryer 301 and the lifespan of the radiation sources 302.

The at least one ventilation opening 313 is preferably situated upstream of the at least one air infeed line 317, and the at least one venting opening is situated downstream of the at least one air removal line 318. At least one conveying device, for example, a pump, is preferably connected to the at least one air infeed line 317, and more preferably, is also at least indirectly connected to the at least one air removal line 318. At least one controllable, and more preferably, adjustable gas valve is preferably provided. This at least one gas valve is preferably manually adjustable and/or coupled to a drive and/or is motor operated, and is preferably embodied as a branch having at least one damper. A first line, connected to the intake of the at least one gas valve, is preferably the at least one air removal line 318. A second line connected to the outlet of the at least one gas valve preferably leads, for example, to a discharge device and/or a recycling device. A third line connected to an outlet of the at least one gas valve preferably leads to the at least one conveying device. At least one additional line, for example, a fresh air line, also leads to the at least one conveying device.

By means of the at least one gas valve, the percentage of air that is removed from the at least one first dryer 301 and that is returned to the at least one first dryer 301 can be adjusted, preferably by means of the at least one conveying device. For this purpose, the at least one gas valve is preferably adjusted such that a percentage, preferably adjustable between 0% and 100%, of the air flowing through the first line, which is connected to the at least one gas valve, is transported to the third line, which is connected to the at least one gas valve, and therefore via the at least one conveying device and the at least one air infeed line 317, back to the at least one first dryer 301. The remaining air that is removed is supplied to the second line, which is connected to the at least one gas valve, and is thereby evacuated. The at least one gas valve therefore determines what percentage of a gas stream flowing through the air removal line 318 is supplied to the air infeed line 317, and what percentage is discharged as exhaust air. This evacuation results in negative pressure, which is preferably automatically compensated for by transporting additional air via the fresh air line, preferably first into the at least one conveying device and into the at least one first dryer 301. The negative pressure itself preferably ensures the suctioning of a necessary volume of air through the fresh air line. The efficacy of the at least one first dryer 301 is thereby improved, since exhaust air that is not fully saturated is reused, resulting in a savings of thermal energy since the warm exhaust air is reintroduced. Moreover, with the necessary processing measures, the volume of air that requires cleaning is reduced.

The at least one ventilation opening 313 and/or the at least one air infeed line 317 and/or the at least one venting opening and/or the at least one air removal line 318 and/or the at least one conveying device and/or the at least one gas valve and/or the at least one second line, which is connected to the at least one gas valve, and/or the at least one discharge device and/or recycling device and/or the at least one third line and/or fresh air line, which is connected to the at least one gas valve, are preferably components of a ventilating device of the at least one first dryer 301. More particularly, this means that the at least one first dryer 301 preferably has the at least one ventilating device, and that the at least one ventilating device comprises the at least one air infeed line 317, which leads to the at least one first dryer 301, and the at least one air removal line 318, which leads away from the at least one first dryer, and the at least one conveying device, which is preferably drivable and/or driven, for example, by means of an electric drive, and that the at least one air removal line 318 is coupled and/or can be coupled via the at least one conveying device to the at least one air infeed line 317. An air infeed line 317 that leads to the at least one first dryer 301 is understood in this case particularly as a line 317, the interior of which is connected to the interior of the at least one first dryer 301, and through the interior of which, during operation of the at least one first dryer 301, a gas flows in the direction of the interior of the at least one dryer 301. An air removal line 318 that leads away from the at least one first dryer in this case is understood particularly as a line 318, the interior of which is connected to the interior of the at least one first dryer 301, and through the interior of which, during operation of the at least one first dryer 301, a gas flows in the direction away from the interior of the at least one dryer 301.

The transport path of the printing material web through the at least one first dryer 301 and particularly through the area of action of the at least one first dryer 301 preferably has a greater vertical component than an optionally existing horizontal component. More particularly, the transport path of the printing material 02 through an area of action of the at least one first dryer 301 preferably extends at least 75% and more preferably at least 95% and more preferably still entirely in at least one direction having a greater vertical component than an optionally existing horizontal component. More preferably, the transport path of the printing material web through the at least one first dryer 301 extends upward in a substantially vertical direction. This serves to ensure that, in the event of a web break, no part of the printing material web will drop from above onto a radiation source 302 and/or come to rest on a radiation source 302. This prevents the printing material web from igniting on the hot radiation sources 302. At least one first support roller 319 is preferably arranged in the interior of the at least one first dryer 301 along the transport path, more preferably such that the at least one first support roller 319 is shielded from the radiation sources 302 by the printing material web 02. The at least one first support roller 319 prevents any uncontrolled flapping of the printing material web 02, which might otherwise be caused by the air flowing out of the at least one ventilation opening 313. A wrap angle of the printing material web 02 around the at least one first support roller 319 preferably measures between 1° and 45°, more preferably between 1° and 25°.

At least one first cooling unit 303 is preferably arranged downstream of the area of action of the at least one radiation source 302 of the at least one first dryer 301 in the direction of transport of the printing material web. The at least one first cooling unit 303 preferably has at least one first cooling roller 304 and preferably has a first cooling impression roller 306 that can be engaged and/or is engaged against the at least one first cooling roller 304, and preferably has at least one deflecting roller 307; 308 that can be engaged and/or is engaged against the at least one first cooling roller 304. The first cooling impression roller 306 preferably has an outer surface which is made of a flexible material, for example, an elastomer. A first drive motor 311, embodied as a first cooling roller drive motor 311 and dedicated to the at least one first cooling roller 304, and the first cooling impression roller 306 are preferably part of a web tension adjustment system, that is, arranged so as to adjust web tension and for this purpose is preferably at least partially and/or temporarily connected to the higher-level machine controller. After leaving the area of action of the first dryer 301, the printing material web 02 wraps first around a first deflecting roller 307, and preferably passes through a roller nip between the first deflecting roller 307 and the at least one first cooling roller 304. On its continued path, the printing material web wraps around the at least one first cooling roller 304 with a wrap angle of preferably at least 180° and more preferably at least 270°. This means that part of an outer surface of the at least one first cooling roller 304, provided as a contact surface between the at least one first cooling roller 304 and the printing material web, has a wrap angle around the at least one first cooling roller 304 which preferably measures at least 180° and more preferably at least 270°. This results in a particularly effective cooling of the printing material web and therefore also enables high dryer outputs. More particularly, a space requirement of the at least one first cooling unit 303 in this case is low, since a high transmission of energy can be achieved with only one cooling roller 304.

The first cooling impression roller 306 and the at least one first cooling roller 304 together form a first cooling roller nip 309, in which the printing material web is located and/or through which the printing material web passes. In this case, the printing material web is pressed by the cooling impression roller 306 against the at least one first cooling roller 304. On its continued path, the printing material web preferably wraps around a second deflecting roller 308 of the at least one first cooling unit 303. The at least one first cooling roller 304 of the at least one first cooling unit 303 is preferably embodied as a cooling roller 304 through which a coolant flows. This means that the coolant flows and/or can flow through at least part of the body of the at least one first cooling roller 304. The coolant is preferably a cooling fluid, for example, water. In a preferred variant, a fluid circuit is connected both with the at least one first cooling unit 303 and the optionally provided second cooling unit 333, and with the temperature control device of the at least one radiation source 302. The cooling roller 304 preferably has the integral cooling roller drive motor 311.

At least one second printing unit 400 is arranged downstream of the at least one first cooling unit 303 along the transport path of the printing material web. At least one second web edge aligner is preferably arranged preferably directly upstream of the at least one second printing unit 400 and preferably downstream of the at least one first dryer 301 and particularly downstream of the at least one first printing unit 200 along the transport path of the printing material web, said web edge aligner being preferably embodied as being manually or power controllable and/or adjustable. The at least one second printing unit 400 is similar in configuration to the first printing unit 200. The at least one second printing unit 400 is preferably configured as substantially and more preferably as fully symmetrical to the at least one first printing unit 200 in terms of the described components. A corresponding plane of symmetry has a horizontal surface normal which is oriented orthogonally to the axial direction A. More particularly, the second printing unit 400 has a second central printing cylinder 401, or central cylinder 401, which is wrapped by the printing material web during printing operation, likewise at a wrap angle of preferably at least 180° and more preferably at least 270°. Accordingly, during printing operation, preferably at least 50% and more preferably at least 75% of an outer cylinder surface of the second central cylinder 401, viewed in the circumferential direction, is in contact with the printing material web. The direction of rotation of the second central cylinder 401 of the second printing unit 400 is preferably opposite the direction of rotation of the first central cylinder 201. Along the transport path of the printing material web, upstream of the central cylinder 401 of the second printing unit 400, a second printing material cleaning device 402 or web cleaning device 402 is preferably arranged so as to act on the printing material web. The second printing material cleaning device 402 is preferably embodied as a second dust removal device 402. The second printing material cleaning device 402 preferably has at least one brush and/or at least one vacuum device and/or a device for electrostatically charging particles that adhere to the printing material web. The second printing material cleaning device 402 is dedicated to at least a second side of the printing material web, particularly aligned so as to act and/or be capable of acting at least on this second side of the printing material web. If the first printing material cleaning device 202 is embodied as acting and/or capable of acting on both sides of the printing material web, the second printing material cleaning device 402 can be dispensed with.

A roller of the second printing unit 400, which is embodied as a second deflecting roller 403, is arranged parallel to the second central cylinder 401 and spaced therefrom by a second gap 404. The transport path of the printing material web through the at least one second printing unit 400 extends similarly to the transport path through the at least one first printing unit 200. More particularly, the printing material web preferably wraps around part of the second deflecting roller 403 and is deflected by said roller such that the transport path of the printing material web 02 in the second gap 404 extends both tangentially to the second deflecting roller 403 and tangentially to the second central cylinder 401. At least one cylinder, embodied as a second impression roller 406, is preferably arranged in the second printing unit 400. The second impression roller 406 preferably has an outer surface which is made of a flexible material, for example, an elastomer. The second impression roller 406 is preferably structured and arranged similarly to the first impression roller 206, particularly with respect to its movability and with respect to a second impression roller nip 409. The second central printing cylinder 401 is preferably arranged and structured similarly to the first central cylinder 201, particularly with respect to a second drive motor 408 and a corresponding second rotational angle sensor, which is embodied as measuring and/or capable of measuring a rotational angle position of the second drive motor 408 and/or of the second central cylinder 401 itself, and as transmitting and/or capable of transmitting this to the higher-level machine controller. The printing material web is placed flat and preferably in a clear and known position against the second central cylinder 401 by the second deflecting roller 403 and/or preferably by the second impression roller 406. More particularly, the second drive motor 408 is preferably embodied as an electric motor, and more preferably as a direct drive and/or independent drive of the second central cylinder 401. The second drive motor 408 of the second central cylinder 401 is preferably embodied as a synchronous, second drive motor 408.

The second rotational angle sensor is likewise embodied as a rotary encoder or absolute value encoder, for example, so that a rotational position of the second drive motor 408 and/or preferably a rotational position of the second central cylinder 401 can preferably be determined in absolute terms by means of the higher-level machine controller. The second drive motor 408 of the second central cylinder 401 is preferably positioned at a first axial end of the second central cylinder 401, in reference to the rotational axis 407 of the second central cylinder 401, whereas the rotational angle sensor is preferably positioned at a second axial end of the second central cylinder 401, in reference to the rotational axis 407 of the second central cylinder 401. The rotational angle sensor preferably likewise has a particularly high resolution, for example, a resolution of at least 3,000 (three thousand) and preferably at least 10,000 (ten thousand) increments per round angle (360°).

In the second printing unit 400, at least one second printing element 411, embodied as an inkjet printing element and also called the second ink-jet printing element, is arranged downstream of the second impression roller 406 in the direction of rotation of the second central cylinder 401 and therefore along the transport path of the printing material web, aligned toward the second central cylinder 401. The at least one second printing element 411 of the at least one second printing unit 400 is preferably identical to the at least one first printing element 211 of the at least one first printing unit 200, particularly with respect to at least one nozzle bar 413, at least one print head embodied as an inkjet print head 412 and the arrangement thereof in double rows, the execution and resolution of the printing method, the arrangement, alignment and actuation of the nozzles and the movability and adjustability of the at least one nozzle bar 413 and the at least one print head 412 by means of at least one adjustment mechanism having a corresponding electric motor. A similar protective cover and/or cleaning device is also preferably provided. A proper alignment of the print heads 412 of the at least one second printing unit 400 is also preferably verified by at least one sensor detecting a printed image and the machine controller evaluating this printed image. This at least one sensor is preferably at least one second printed image sensor, which is similar in embodiment to the at least one first printed image sensor. The at least one second printing element 411 is preferably embodied as a four-color printing element.

The printing machine 01 preferably has at least one register sensor, which senses the position of at least one and preferably of each first printed image applied by the at least one first printing element 211 onto the first side of the printing material web, and transmits this to the higher-level machine controller. A barcode can be used as the at least one printed image which is detected by the register sensor, for example, and is applied for this purpose to the printing material web in the first printing unit 200. Such a barcode can contain information about the content and/or the dimensions of a printed image applied to the printing material web by the first printing unit 200. This serves to ensure the maintenance of register, even if the cutting-off length, that is, the length of the printed images that are applied in the direction of the transport path of the printing material web, is adjusted, for example. The higher-level machine controller uses the position of this printed image to calculate the ideal time period for actuating the nozzles of the print heads 412 of the at least one second printing element 411. A true-to-register alignment of the first printed image on the first side of the printing material web and of the second printed image on the second side of the printing material web is thereby achieved.

The register sensor is preferably positioned closer to the second central cylinder 401 than to the first central cylinder 201. This allows the greatest possible number of factors to which the printing material web is exposed along its transport path between the at least one first printing element 211 and the at least one second printing element 411, such as stretching of the printing material web along the transport path, to be taken into consideration. The at least one register sensor is preferably embodied as at least one surface camera. Such a surface camera preferably has a high enough resolution capability that it can detect register errors and/or color registration errors, for example, a resolution capability of better than 0.05 mm. The at least one register sensor is preferably identical to the at least one first printed image sensor, which is used to monitor and control the actuation of all print heads and/or double rows of print heads of the first printing element 211, positioned and/or acting one in front of the other in the circumferential direction of the first central cylinder 201.

At least one second dryer 331 is situated downstream of the at least one second printing unit 400 with respect to the transport path of the printing material web. Once the printing material web has passed through the at least one second printing unit 400, the printing material web is transported further along its transport path and is fed to the at least one second dryer 331 of the at least one dryer unit 300. The at least one second dryer 331 is preferably structured similarly to the at least one first dryer 301. The at least one first dryer 301 and the at least one second dryer 331 are components of the at least one dryer unit 300. An area of action of the at least one first dryer 301 with respect to the printing material web 02 preferably points away from the at least one second dryer 331, and an area of action of the at least one second dryer 331, with respect to the printing material web 02, preferably points away from the at least one first dryer 301. A section of the transport path of the printing material web passing through the at least one first dryer and the at least one second dryer 331 preferably extends between the at least one first dryer 301 and the at least one second dryer 331.

The second side of the printing material web, which has been imprinted by the at least one second printing unit 400, is preferably not in contact with any component of the web-fed printing machine 01 between a last point of contact of the printing material web with the second central cylinder 401 of the at least one second printing unit 400 and an area of action of the at least one second dryer 301. The first side of the printing material web, which has been imprinted by the first printing unit 200 and already dried, and which is not imprinted by the second printing unit 400 and is in contact with the second central cylinder 401 of the at least one second printing unit 400, is preferably in contact with at least one deflecting roller 414 of the at least one second printing unit 400 and/or with at least one deflecting roller 342 of the at least one second dryer 331 between the last point of contact of the printing material web 02 with the second central cylinder 401 of the at least one second printing unit 400 and the area of action of the at least one second dryer 331. At least one deflecting roller 414 of the second printing unit 400 is preferably provided, which deflects the printing material web 02, once said web has been released from the second central cylinder 401 in a direction having a greater vertical, preferably downward oriented component than an optionally existing horizontal component into a direction having a greater horizontal component than an optionally existing vertical component. In this case, only the first side of the printing material web, which has not been imprinted by the second printing unit 400, is in contact with this at least one deflecting roller 414 of the second printing unit 400. At least one deflecting roller 342 of the at least one second dryer 331 is preferably provided, which deflects the printing material web from this direction or from another direction having a greater horizontal component than an optionally existing vertical component into a direction having a greater vertical, preferably upward oriented component than an optionally existing horizontal component. In this case, only the first side of the printing material web which has not been imprinted by the second printing unit 400 is in contact with the at least one deflecting roller 342 of the at least one second dryer 331.

The at least one second dryer 331 is likewise preferably embodied as an infrared radiation dryer. The structure of the at least one second dryer 331 is similar to the structure of the at least one first dryer 301, particularly with respect to an embodiment as an air flow dryer and/or a radiation dryer and/or a hot air dryer and/or a UV radiation dryer. More particularly, the at least one second dryer 331 preferably has at least one second cooling roller 334, which further preferably represents at least one sixth motor-driven rotating body 334. The second cooling roller 334 is preferably driven and/or drivable by means of a second cooling roller drive 341. The at least one second dryer 331 is preferably configured as substantially and more preferably as fully symmetrical to the at least one first dryer 301 in terms of the described components. The at least one second dryer 331 likewise preferably has a ventilating device, which is configured similarly to the ventilating device of the at least one first dryer 301 and/or is coupled therewith or identical thereto.

The at least one second dryer 331 is preferably part of the same dryer unit 300 as the at least one first dryer 301 and is more preferably located in the same housing 329. In terms of spatial arrangement, the dryer unit 300, and therefore preferably the at least one first dryer 301 and the at least one second dryer 331, is preferably positioned between the at least one first printing unit 200 and the at least one second printing unit 400. This means that a straight line connecting the rotational axis 207 of the at least one first central cylinder 201 of the at least one first printing unit 200 with a rotational axis 407 of at least one second central cylinder 401 of at least one second printing unit 400 is preferably arranged intersecting the at least one dryer unit 300.

At least one drawing roller 501 is located downstream of the at least one second dryer 331 along the transport path of the printing material web. The at least one drawing roller 501, together with a drawing impression roller 502 which is engaged and/or engageable against the at least one drawing roller 501, forms a drawing nip 503 in which the printing material web is clamped and through which the printing material web is conveyed. The drawing impression roller 502 preferably has an outer surface made of a flexible material, for example, an elastomer. The drawing nip 503 preferably serves to adjust a web tension.

At least one post-processing apparatus 500, preferably embodied as a folding device and/or having a sheet cutter and/or a flat delivery unit, is positioned downstream of the drawing nip 503 along the transport path of the printing material web. In this and/or by this post-processing apparatus 500, the printing material web is preferably folded and/or cut and/or sorted and/or packaged in envelopes and/or shipped. A rewetting device is preferably arranged upstream or downstream of the drawing roller 501, but particularly downstream of the at least one first dryer 301 along the transport path of the printing material, and preferably compensates for an excessive loss of moisture from the printing material web as a result of processing by the printer unit 300.

The transport path of the printing material web through the printing machine 01 can be divided into multiple sections. Along the transport path of the printing material web through the web-fed rotary printing machine, at least the infeed nip 119, the first impression roller nip 209, the first cooling roller nip 309, the second impression roller nip 409, the second cooling roller nip 339, and the drawing nip 503 are arranged. These are preferably used for adjusting web tension. A first section of the transport path starts at the printing material roll 101 in the roll unwinding device 100 and preferably extends first over the dancer roller 113 and through the web edge aligner 114 into the infeed nip 119. The web tension in this first section is preferably adjusted by adjusting the rotational speed of the at least one drive motor 104 of the chucking device 103 such that the dancer lever 121 that supports the dancer roller 113 remains in a central position.

A second section of the transport path starts at the infeed nip 119 and extends around at least one first measuring roller 216 and around the first deflecting roller 203 and around the first central cylinder 201 into the first impression roller nip 209 of the at least one first printing unit 200. The transport path, starting from the infeed nip 119, preferably extends first with a greater horizontal component than an optionally existing vertical component to beyond the at least one first printing unit 200, and then with a greater vertical, downward oriented component than an optionally existing horizontal component, to a height that is below the first central cylinder 201, and then with a greater horizontal component than an optionally existing vertical component below the rotational axis 207 of the first central cylinder 201, and then around the first measuring roller 216 and around the first deflecting roller 203 on the outer surface of the first central cylinder 201, and into the first impression roller nip 209. The web tension in this second section is preferably adjusted in that the web tension is measured by the first measuring roller 216, and a rotational speed of the first central cylinder 201 is adjusted by means of the drive motor 208 thereof such that the web tension at the first measuring roller 216 remains constant.

A third section of the transport path starts at the first impression roller nip 209 and extends through the at least one first dryer 301 into the first cooling roller nip 309. The transport path preferably extends starting from the first impression roller nip 209 through the at least one first printing element 211 and around the at least one deflecting roller 214, embodied as a second measuring roller 214, of the first printing unit 200, and around the at least one deflecting roller 312 of the at least one first dryer 301 and through the at least one first dryer 301 and around the first deflecting roller 307 of the first cooling unit 303 and around the first cooling roller 304 into the first cooling roller nip 309. The web tension in this third section is preferably adjusted in that the web tension is measured by means of the second measuring roller 214, and the rotational speed of the first cooling roller 303 is adjusted by means of the drive motor 311 thereof such that the web tension at the second measuring roller 214 remains constant.

A fourth section of the transport path starts at the first cooling roller nip 309 and extends around at least one third measuring roller 416 and around the second deflecting roller 403 and around the second central cylinder 401 into the second impression roller nip 409 of the at least one second printing unit 400. The transport path preferably extends, starting from the first cooling roller nip 309, first with a greater horizontal component than an optionally existing vertical component to beyond the at least one first dryer 301 and the at least one second dryer 331, and then with a greater vertical, downward oriented component than an optionally existing horizontal component to a height that is below the second central cylinder 401, and then with a greater horizontal component than an optionally existing vertical component below the rotational axis 407 of the second central cylinder 401, and then around a third measuring roller 416 and around the second deflecting roller 403 onto the outer surface of the second central cylinder 401 and into the second impression roller nip 409. The web tension in this fourth section is preferably adjusted in that the web tension is measured by means of the third measuring roller 416, and a rotational speed of the second central cylinder 401 is adjusted by means of the drive motor 408 thereof such that the web tension at the third measuring roller 416 remains constant.

A fifth section of the transport path starts at the second impression roller nip 409 and extends through the at least one second dryer 331 into a second cooling roller nip 339. The transport path preferably extends starting from the second impression roller nip 409 through the at least one second printing element 411 and around the at least one deflecting roller 414, embodied as a fourth measuring roller, of the second printing unit 400 and around the at least one deflecting roller 342 of the at least one second dryer 331 and through the at least one second dryer 331 and around a third deflecting roller 337 of a second cooling unit 333 and around a second cooling roller 334 into the second cooling roller nip 339, which is formed by the second cooling roller 334 and the second cooling impression roller 336. The web tension in this fifth section is preferably adjusted in that the web tension is measured by means of the fourth measuring roller 414, and a rotational speed of the second cooling roller 333 is adjusted by means of the drive motor 341 thereof such that the web tension at the fourth measuring roller 414 remains constant.

A sixth section of the transport path starts at the second cooling roller nip 339 and extends between the at least one first dryer 301 and the at least one second dryer 331, and around at least one fifth measuring roller 343, through the drawing nip 503. The web tension in this sixth section is preferably adjusted in that the web tension is measured by means of the fifth measuring roller 343, and the rotational speed of the drawing roller 501 is adjusted by means of the drive thereof such that the web tension at the fifth measuring roller 343 remains constant.

All measuring rollers and/or other measuring devices for measuring web tension and all drive motors are preferably connected to the higher-level machine controller, and further preferably to an electronic master control axis. The higher-level machine controller preferably influences all the drive motors of rotating bodies located upstream and/or downstream with respect to the transport path of the printing material web 02 as soon as a drive motor is influenced on the basis of a measurement. In another embodiment, the web tension in each of the individual sections is adjusted separately. This results in indirect changes to the web tension in the adjoining sections, which are then automatically compensated for.

In a simplified variant, the first cooling roller nip 309 and/or the second cooling roller nip 339 are dispensed with, so that the stated third section and the stated fourth section form a combined section and/or the stated fifth section and the stated sixth section form a combined section.

The invention claimed is:

1. A printing machine, wherein the printing machine has at least one first printing unit and at least one first dryer, wherein the at least one first printing unit has at least one inkjet print head, at least one first central cylinder, and an integral first drive motor dedicated to the at least one first central cylinder, and wherein the at least one first dryer is embodied as a radiation dryer having a radiation source, and wherein at least one first cooling unit is arranged downstream of the radiation source of the at least one first dryer along a transport path of a printing material through the printing machine, characterized in that the at least one first dryer has at least one ventilating device, which has at least one air infeed line and at least one air removal line, and in that the transport path of the printing material through an area of action of the at least one first dryer extends at least 75% in at least one direction having a greater vertical component than an optionally existing horizontal component, and in that a straight line connecting a rotational axis of the at least one first central cylinder of the at least one first printing unit with a rotational axis of at least one second central cylinder of at least one second printing unit intersects at least one dryer unit, which includes the at least one first dryer.

2. The printing machine according to claim 1, characterized in that the at least one first dryer, which is followed by at least one second printing unit, which is followed by at least one second dryer are arranged downstream of the at least one first printing unit along the transport path of the printing material through the printing machine.

3. The printing machine according to claim 1, characterized in that the at least one first dryer is embodied as an infrared radiation dryer.

4. The printing machine according to claim 1, characterized in that the at least one first cooling unit has at least one first cooling roller.

5. The printing machine according to claim 4, characterized in that part of an outer surface of the at least one first cooling roller, which is provided as a contact surface between the at least one first cooling roller and the printing material, has a wrap angle around the at least one first cooling roller measures at least 180°.

6. The printing machine according to claim 4, characterized in that a first cooling impression roller is provided, and which is engageable against the at least one first cooling roller.

7. The printing machine according to claim 6, characterized in that the at least one first cooling roller has an integral drive motor dedicated to the at least one first cooling roller.

8. The printing machine according to claim 7, characterized in that the drive motor which is dedicated to the at least one cooling roller, and the first cooling impression roller are part of a web tension adjustment system and are connected to a machine controller of the printing machine.

9. The printing machine according to claim 1, characterized in that the area of action of the at least one first dryer is composed of areas of action of all radiation sources of the at least one first dryer.

10. The printing machine according to claim 1, characterized in that the at least one ventilating device of the at least one first dryer has the at least one air infeed line with at least one ventilation opening connected thereto, and the at least one air removal line with at least one venting opening connected thereto.

11. The printing machine according to claim 1, characterized in that at least one ventilation opening, which is connected to the at least one air infeed line, is arranged between at least two radiation sources of the at least one first dryer.

12. The printing machine according to claim 1, characterized in that a positive pressure is maintained in the at least one first dryer.

13. The printing machine according to claim 1, characterized in that at least one rewetting unit is arranged downstream of the at least one first dryer (301) along the transport path of the printing material.

14. The printing machine according to claim 1, characterized in that part of the outer surface of the at least one first central cylinder, which part is provided as a contact surface between the at least one first central cylinder and a printing material, has a wrap angle around the at least one first central cylinder of at least 270°.

15. The printing machine according to claim 1, characterized in that a first side of the printing material web which has been imprinted by the at least one first printing unit is not in contact with any component of the printing machine between a last point of contact of the printing material web with the at least one first central cylinder of the at least one first printing unit and an area of action of the at least one first dryer.

16. The printing machine according to claim 1, characterized in that a second side of the printing material web, which is in contact with the first central cylinder of the at least one first printing element, is in contact with at least one of a deflecting roller of the at least one first printing unit and/or with at least one deflecting roller of the at least one first dryer between a last point of contact of the printing material web with the at least one first central cylinder of the at least one first printing unit and the area of action of the at least one first dryer.

17. The printing machine according to claim 1, characterized in that an infeed nip, which is formed by a traction roller and a traction impression roller, is arranged between a web edge aligner at least two alignment rollers and the at least one first central cylinder, along a transport path of a printing material web.

18. The printing machine according to claim 1, characterized in that at least one infeed nip, a first impression roller nip, a first cooling roller nip a second impression roller nip, a second cooling roller nip and a drawing nip are arranged along a transport path of a printing material through the printing machine.

19. The printing machine according to claim 1, characterized in that the printing machine is embodied as a web-fed inkjet printing machine.

20. The printing machine according to claim 1, characterized in that a temperature control device of the at least one first dryer has at least one liquid temperature-controlled component.

* * * * *